US006821406B2

(12) United States Patent
Kobori et al.

(10) Patent No.: US 6,821,406 B2
(45) Date of Patent: Nov. 23, 2004

(54) METHOD FOR SURFACE TREATMENT OF GOLD-PLATED BODY AND SURFACE-TREATED PRODUCT, AND PROCESS FOR PRODUCING GOLD-PLATED BODY AND GOLD-PLATED BODY, AND METHOD FOR IMMOBILIZATION OF SULFUR-CONTAINING MOLECULES

(75) Inventors: Shinichi Kobori, Tokyo (JP); Kazuhiro Nakama, Kokubu (JP); Hiroyoshi Miyahara, Chiba (JP)

(73) Assignees: Kyocera Corporation, Kyoto (JP); Tum Gene, Inc., Chiba (JP)

( * ) Notice: Subject to any disclaimer, the term of this patent is extended or adjusted under 35 U.S.C. 154(b) by 171 days.

(21) Appl. No.: 10/067,502

(22) Filed: Feb. 7, 2002

(65) Prior Publication Data

US 2002/0162748 A1 Nov. 7, 2002

(30) Foreign Application Priority Data

Feb. 8, 2001 (JP) ..... 2001-032735
Jan. 31, 2002 (JP) ..... 2002-023914

(51) Int. Cl.[7] ..... C25D 5/50; C22F 1/14

(52) U.S. Cl. ..... 205/227; 148/678
(58) Field of Search ..... 205/224, 227; 148/678

(56) References Cited

U.S. PATENT DOCUMENTS

| | | | | |
|---|---|---|---|---|
| 4,343,684 A | * | 8/1982 | Lechtzin | 205/50 |
| 4,840,893 A | * | 6/1989 | Hill et al. | 435/6 |
| 5,108,576 A | | 4/1992 | Malmros et al. | |
| 5,614,004 A | * | 3/1997 | Wachi et al. | 106/1.23 |
| 5,873,992 A | * | 2/1999 | Glezen et al. | 205/159 |
| 6,048,692 A | | 4/2000 | Maracas et al. | |
| 6,093,370 A | | 7/2000 | Yasuda et al. | |
| 6,126,800 A | | 10/2000 | Caillat et al. | |
| 6,340,568 B2 | | 1/2002 | Hefti | |
| 6,368,851 B1 | | 4/2002 | Baumann et al. | |

FOREIGN PATENT DOCUMENTS

| | | | | |
|---|---|---|---|---|
| JP | 56-152958 A | * | 11/1981 | C23C/3/02 |
| JP | 9288080 | | 11/1997 | |
| JP | 09-288085 | | 11/1997 | |

OTHER PUBLICATIONS

Bain, C. D. et al., Formation of Monolayer Films by the Spontaneous Assembly of Organic Thiols from Solution onto Gold, J. Am. Chem. Soc., 111: 321–335 (1989).
Gooding, J. J. et al., Platinum–Catalyzed Enzyme Electrodes Immobilized on Gold Using Self–Assembled Layers, Anal. Chem, 70: 2396–2402 (1998).
Downs, Mark, et al:, "New DNA Technology and the DNA Biosensor," Analytical Letters, vol. 20 (12), pp. 1897–1927 (1987).
Hashimoto, Koji, et al., "DNA sensor for electrochemical gene detection," Preparing for Clinical Care Analyses in the 21st Century, 16th International Symposium, 1996.
Molinier–Jumel, Catherine, et al., "Electrochemical Study of DNA–Anthracyclines Interaction," Biochemical and Biophysical Research Communications, vol. 84, No. 2, pp. 441–449 (1978).
Palecek, Emil, "Adsorptive Transfer Stripping Voltammetry: Determination of Nanogram Quantities of DNA Immobilized at the Electrode Surface," Analytical Biochemistry vol. 170, pp. 421–431 (1988).
Takenaka, Shigeori, et al., "Bis–9–acridinyl Derivative Containing a Viologen Linker Chain: Electrochemically Active Intercalator for Reversible Labelling of DNA," J. Chem. Soc., Chem. Commun., vol. 21, pp. 1485–1487 (1990).
Takenaka, Shigeori, et al., "DNA Sensing on a DNA Probe–Modified Electrode Using Ferrocenylnaphthalene Diimide as the Electrochemically Active Ligand," Anal. Chem. vol. 72, pp. 1334–1341 (2000).
Takenaka, Shigeori, et al., "Electrochemically active threading intercalator with high stranded DNA selectivity," J. Chem. Soc., Chem. Commun., No. 10, pp. 1111–1112 (1998).
Takenaka, Shigeori, "Synthetic threading intercalators as a new analytical probe for nucleic acid and gene detection," Business Kagaku, vol. 48, No. 12, pp. 1095–1105 (1999).
Takenaka, Shigeori, et al., "Threading Intercalators as a New DNA Structural Probe," Bull. Chem. Soc. Jpn. vol. 72, pp. 327–337 (1999).
Yamashita, Kenichi, et al., "Electrochemical Detection of Base Pair Mutation," Chemistry Letters, pp. 1038–1039 (2000).
Ihara, Toshihiro et al., "Synthesizing and Applying the Bis–Intercalator as an Electrochemical Detection Probe of DNA," Proceedings of the Japan Society for Analytical Chemistry, p. 54 (1989).
Takanaga, Shigeori et al., "Synthesizing the Electrochemical Threading Type Intercalator and Applying the Electrochemical Threading Type Intercalator to a DNA Sensor," Proceedings of the Japan Society for Analytical Chemistry, pp. 137–138 (1996).

* cited by examiner

*Primary Examiner*—Roy King
*Assistant Examiner*—Harry D. Wilkins, III
(74) *Attorney, Agent, or Firm*—Covington & Burling

(57) ABSTRACT

The present invention provides a gold-plated body, a method for surface treatment of a gold-plated body, a surface-treated product, and an immobilization method which make it possible to immobilize a large number of sulfur-containing molecules. With the surface treatment method in accordance with the present invention, the surface of a gold-plated body is subjected to an annealing treatment at a temperature of 350 to 790° C. so that a large number of sulfur-containing molecules can be immobilized thereon. In particular, the treatment is conducted so as to obtain a structure in which surface gold crystals have no less than 30% planes with (1, 1, 1) orientation. The present invention also provides a method for the manufacture of a gold-plated body that allows a large number of sulfur-containing molecules to be immobilized on the surface thereof, by which surface gold crystals are formed from a starting material comprising a crystal growth enhancer.

15 Claims, No Drawings

METHOD FOR SURFACE TREATMENT OF GOLD-PLATED BODY AND SURFACE-TREATED PRODUCT, AND PROCESS FOR PRODUCING GOLD-PLATED BODY AND GOLD-PLATED BODY, AND METHOD FOR IMMOBILIZATION OF SULFUR-CONTAINING MOLECULES

BACKGROUND OF THE INVENTION

1. Field of the Invention

The present invention relates to a method for surface treatment of a gold-plated body, a surface-treated product, a method for the manufacture of a gold-plated body, a gold-plated body, and an immobilization method which make it possible to immobilize a large number of sulfur-containing molecules.

2. Description of Prior Art

A technology for immobilizing sulfur-containing molecules having S—H groups, S—S groups, and the like on the surface of gold (Au) (bonding of S—H groups and gold is described in J. Am. Chem. Soc., No. 111, p. 321~, 1989, by C. D. Bain et al., and in Anal. Chem. No. 70, p. 2396~, 1998, by J. J. Gooding et al.) has been known in a variety of fields such as immobilization of probes in gene detection (target gene probe), immobilization of self-assembled monolayers (SAM) as resists (photosensitive agents), and the like.

Gold-plated bodies prepared by plating gold by a usual plating method on the surface of a substrate such as alloy substrate have been used as gold serving as immobilization substrates for such sulfur-containing molecules.

However, a problem associated with such gold-plated bodies was that only a small amount of sulfur-containing molecules could be immobilized on the surface thereof. This was apparently because the orientation of gold crystal structure on the surface of gold plated body was not constant which resulted in a decreased amount of bonds (coordination bonds) between gold and S—H groups or S—S groups contained in the sulfur-containing molecules.

Appropriately changing gold plating conditions such as temperature in the process of forming a gold-plated body was considered as a means for obtaining a constant orientation of surface structure of the gold-plated body and immobilizing a large amount of sulfur-containing molecules on the gold-plated body. However, changing of such conditions was in reality difficult.

SUMMARY OF THE INVENTION

Accordingly, it is an object of the present invention to provide a method for surface treatment of a gold-plated body, a surface-treated product, and an immobilization method which make it possible to immobilize a large amount of sulfur-containing molecules.

The results of the intensive study conducted by the inventors demonstrated that the above-described object can be attained by a method by which the surface of a gold-plated body after gold plating is annealed within the specific temperature range.

The present invention is based on this finding and it provides a method for surface treatment of a gold-plated body, by which the surface of the gold-plated body is subjected to annealing at a temperature of 350 to 790° C. so that a large number of sulfur-containing molecules could be immobilized.

The present invention also provides a surface-treated product of the gold-plated body that was treated by the above-described surface treatment method.

The present invention also provides a method for the immobilization of sulfur-containing molecules by which a large number of sulfur-containing molecules are immobilized on the surface treated product of the gold-plated body that was treated by the above-described surface treatment method.

Furthermore, the inventors have also found that the above-mentioned object can be attained by a gold-plated body manufactured from a starting material having a specific additive added thereto.

The present invention is based on this finding and provides a method for the manufacture of a gold-plated body by which surface gold crystals are formed from a starting material comprising a crystal growth enhancer, this method manufacturing a gold-plated body allowing a large number of sulfur-containing molecules to be immobilized on the surface.

Moreover, the present invention provides a gold-plated body obtained by the aforesaid manufacturing method.

The present invention also provides a method for immobilizing sulfur-containing molecules which immobilizes a large number of sulfur-containing molecules on the gold-plated body obtained by the aforesaid manufacturing method.

DESCRIPTION OF THE PREFERRED EMBODIMENTS

Method for Surface Treatment of Gold-Plated Body

The method for surface treatment of a gold-plated body in accordance with the present invention will be described below in greater detail based on the preferred embodiments thereof.

With the surface treatment method in accordance with the present invention, the surface of the gold-plated body is subjected to annealing at a temperature of 350 to 790° C. so that a large number of sulfur-containing molecules could be immobilized (preferably so that a large number of sulfur-containing molecules comprising S—H groups or S—S groups could be immobilized via the S—H groups or S—S groups). Annealing at a temperature within this range makes it possible to obtain a surface-treated product that can immobilize a large number of the aforesaid sulfur-containing molecules.

In accordance with the present invention, the annealing is conducted according to JIS K 6900.

As mentioned above, the annealing temperature is 350 to 790° C., the temperature referred to herein being the peak temperature (maximum temperature). More specifically, the annealing is conducted by raising the temperature at a rate of 5 to 30° C./min from the initial temperature (room temperature, usually 10 to 30° C.), terminating temperature increase when the above-mentioned temperature, which is the peak temperature, is reached and then holding at a constant temperature.

When the annealing temperature is less than 350° C., the amount of the sulfur-containing molecules on the surface of the gold-plated body is insufficient. On the other hand, if the annealing temperature exceeds 790° C., a problem is associated, for example, with melting of the substrate constituting the gold-plated body or peripheral components of such substrate. Thus, when the substrate is used in a state in which it is vertically joined to a support with an Ag solder (eutectic Ag—Cu), the Ag solder can be remelted and the substrate can fall.

From the standpoint of increasing the amount of immobilized sulfur-containing molecules and preventing the negative effect on the substrate and peripheral components thereof, it is especially preferred that the annealing temperature be 450-700° C.

The treatment time of annealing is adjusted appropriately according to the treatment temperature within the above-described range. Typically, the treatment is conducted for 30 to 600 min.

It is especially preferred that the treatment at a temperature of 350 to 600° C. be conducted for 30 to 240 min.

Furthermore, it is preferred that the treatment at a temperature of 600 to 790° C. be conducted for 60 to 240 min.

The annealing is usually conducted in the presence of a reducing gas (a mixture of hydrogen and nitrogen), but such a condition is not limiting and the treatment may be conducted under 100% hydrogen, 100% nitrogen, or vacuum.

It is especially preferred that the annealing be conducted so as to obtain a structure in which surface gold crystals in the obtained surface-treated product have no less than 30%, in particular, no less than 60% planes with a (1, 1, 1) orientation. Such (1, 1, 1) planes provide for closest-packed structure of gold atoms, and when the crystal structure with a content ratio of (1, 1, 1) planes of no less than a specific value is present on the surface, the orientation becomes constant and apparently a constant number of bonding positions for S—H groups or S—S groups contained in the sulfur-containing molecules can be guaranteed.

The method for measuring the content ratio of (1, 1, 1) planes is presented in the below-described preferred embodiment.

With the surface treatment method in accordance with the present invention, no specific limitation is placed on the gold-plated body which is the object of annealing, and bodies obtained by plating the surface of a variety of substrates by various well known methods (for example, electroplating, chemical (electroless) plating, and the like) can be used.

In accordance with the present invention, it is preferred that the gold-plated body be an electroplated body prepared by using an electrically conductive substrate composed of an alloy comprising cobalt, nickel, iron, and the like, immersing the substrate into a gold plating solution, after optional priming, and passing an electric current through the electrically conductive substrate and the gold plating solution. The especially preferred is an electroplated body suitable for applications as a pin serving as a detection electrode employed in the method for electrochemical detection of genes, e.g., of DNA, RNA, and the like having a specific sequence. In case of pins of detection tips, the surface where the genes are immobilized by introduction of S—H groups or S—S groups, that is, the front end of the pin, is annealed.

When an electroplated body is used, in the process for forming the electroplated body, it is preferred that a crystal growth enhancer be added, preferably, in an amount of 0.5~5 ppm (based on weight standard) to a gold plating solution into which an electrically conductive substrate is to be immersed. Employing the electroplated body formed by using the gold plating solution having a crystal growth enhancer thus added thereto in the surface treatment method in accordance with the present invention is preferred because it raises the content ratio of (1, 1, 1) planes in the surface gold crystals on the obtained surface-treated product and further increases the immobilization ratio of sulfur-containing molecules.

Examples of suitable crystal growth enhancers include thallium (Tl)-containing crystal growth enhancers such as thallium sulfate, thallium chloride, thallium nitrate, and the like, and lead (Pb)-containing crystal growth enhancers such as lead chloride, lead citrate, and the like. Thallium-containing crystal growth enhancers are especially preferred because they provide for excellent content ratio of (1, 1, 1) planes and immobilization ratio of sulfur-containing molecules.

Examples of sulfur-containing molecules immobilized by the surface-treated product of gold-plated body which is obtained by the surface treatment method in accordance with the present invention include not only the sulfur-containing molecules having S—H groups or S—S groups, but all of the sulfur-containing molecules that can be immobilized on the gold surface.

In accordance with the present invention, the preferred sulfur-containing molecules contain nucleic acid residues, protein residues, or protein-bondable groups.

Examples of sulfur-containing molecules containing nucleic acid residues include molecules obtained by introducing S—H groups or S—S groups into nucleic acids such as DNA, RNA, and the like.

Examples of sulfur-containing molecules containing protein residues include molecules obtained by introducing S—H groups or S—S groups into proteins, or proteins having an S atom in a molecule.

Examples of sulfur-containing compounds containing a protein-bondable group include compounds obtained by introducing a protein-bondable group such as a carboxyl group or amido group by a linker or the like into a compound having an S—H group or S—S group. Such compounds can be immobilized by forming a SAM (self-assembled monolayers) on the surface on the gold-plated body surface. 4,4'-Dithio Dibutyric Acid (DDA) is a specific example of the sulfur-containing compound comprising a protein-bondable group. Once such sulfur-containing compound comprising a protein-bondable group has been immobilized, bonding a protein to the protein-bondable group makes it possible to use it as a protein tip. For example, when DDA is used as a sulfur-containing compound containing a protein-bondable group, DDA is immobilized by forming a SAM on the gold-plated body surface via an S—S group contained in the molecule, then a carboxyl group serving as a protein-bondable end group of the immobilized DDA is activated with EDA (water-soluble carbodiimide) or NHS (N-hydroxysuccinic acid imide), and a protein is bonded thereto.

Furthermore, in accordance with the present invention, it is also preferred that a probe (preferably, a probe with an S—H group or S—S group introduced thereinto) for the detection of a gene (target gene) with unconfirmed based sequence serve as the above-mentioned sulfur-containing molecule. A gene having a base pair portion complementary to the target gene can be used. More specifically, a plurality of PCR products, oligonucleotides, mRNA, cDNA, PNA (peptidic nucleic acid), or LCA (locked nucleic acid; Proligo, trade name of LLC Co., Ltd.) having the same or different gene sequence can be used.

With the surface treatment method in accordance with the present invention, the treatment is conducted so that a large number of such probes are also immobilized on the surface of the gold-plated body via S—H groups or S—S groups. Therefore, the number of probes immobilized on the obtained surface-treated product can be increased and then the number of genes with unconfirmed base sequence that can be detected can be increased.

Surface-Treated Product of Gold-Plated Body

The present invention can provide a surface treated product of the gold-plated body treated by the above-described surface treatment method. Such surface treated product of the gold-plated body can immobilize the above-described plurality of sulfur-containing molecules (preferably, a large number of sulfur-containing molecules having S—H groups or S—S groups).

The surface treated product in accordance with the present invention has a structure in which the surface gold crystals usually have no less than 30% planes with a (1, 1, 1) orientation. The surface treated product in accordance with the present invention, which has such a structure on the surface thereof can immobilize a large number of the above-mentioned sulfur-containing molecules.

Method for Immobilization of Sulfur-Containing Molecules

Furthermore, the present invention can also provide a method for the immobilization (method for the immobilization of sulfur-containing molecules) of a large number of sulfur-containing molecules (preferably, a large number of sulfur-containing molecules having S—H groups or S—S groups) on the surface-treated product of the gold-plated body treated by the above-described surface treatment method. With such an immobilization method, the sulfur-containing molecules can be immobilized on a gold-plated body in an amount unattainable by the conventional methods. The method for measuring the immobilized amount is presented in the below-described examples.

Method for Manufacture of Gold-Plated Body

The present invention provides a method for the manufacture of a gold-plated body by which surface gold crystals are formed from a starting material comprising a crystal growth enhancer, this method manufacturing a gold-plated body allowing a large number of sulfur-containing molecules to be immobilized on the surface.

With the manufacturing method in accordance with the present invention, it is especially preferred that a gold-plated body be obtained by adding a crystal growth enhancer to a gold plating solution, immersing an electrically conductive substrate therein, and passing an electric current through the electrically conductive substrate and the gold plating solution having the crystal growth enhancer added thereto. For example, a gold-plated substrate is obtained by using an electrically conductive substrate composed of an alloy containing cobalt, nickel, iron, and the like, optionally priming the electrically conductive substrate, then immersing it into a gold plating solution having a crystal growth enhancer added thereto and passing an electric current through the electrically conductive substrate and the gold-plating solution containing the crystal growth enhancer. It is especially preferred to form an electroplated body suitable for applications as a pin serving as a detection tip electrode employed in the method for electrochemical detection of genes, e.g., of DNA, RNA, and the like having a specific sequence.

It is also preferred that the gold-plated body be formed so as to obtain a structure in which surface gold crystals have no less than 30%, in particular, no less than 60% planes with a (1, 1, 1) orientation. When a pin of a detection tip is formed, it is especially preferred that the formation be conducted so as to obtain such a structure at least on the front end of the pin, that is, on the surface where S—H groups or S—S groups are introduced into a gene and immobilized.

In the manufacturing method in accordance with the present invention, it is preferred that a crystal growth enhancer be added, preferably, in an amount of 0.5~5 ppm (based on weight standard) to a starting material of a gold plating solution. When the amount of the crystal growth enhancer is within this range, the content ratio of (1, 1, 1) planes in the surface gold crystals on the obtained gold-plated body is raised and the immobilization ratio of sulfur-containing molecules is further increased.

Examples of suitable crystal growth enhancers include thallium (Tl)-containing crystal growth enhancers such as thallium sulfate, thallium chloride, thallium nitrate, and the like, and lead (Pb)-containing crystal growth enhancers such as lead chloride, lead citrate, and the like. Thallium-containing crystal growth enhancers are especially preferred because they provide for excellent content ratio of (1, 1, 1) planes and immobilization ratio of sulfur-containing molecules.

Examples of sulfur-containing molecules that are immobilized on the surface of the gold-plated body obtained by the manufacturing method in accordance with the present invention are identical to the sulfur-containing molecules immobilized on the surface treated product obtained by the above-described surface treatment method. Therefore, in the manufacturing method in accordance with the present invention, it is also preferred that the sulfur-containing molecules contain nucleic acid residues, protein residues, or protein-bondable groups, or that a probe be used for the detection of a gene with an unconfirmed base sequence. Since such a probe is also treated so as to immobilize a large number of molecules on the surface of a gold-plated body via S—H groups or S—S groups, the number of probes for immobilization onto the obtained gold-plated body is increased and, therefore, the number of genes with an unconfirmed base sequence that can be detected can be increased.

Gold-plated body

The present invention can provide a gold-plated body obtained by the above-described manufacturing method. Such a gold-plated body can immobilize a large number of sulfur-containing molecules (preferably, a large number of sulfur-containing molecules having S—H groups or S—S groups).

The gold-plated body in accordance with the present invention has a structure in which the surface gold crystals usually have no less than 30% planes with a (1, 1, 1) orientation. The gold-plated body in accordance with the present invention, which has such a structure on the surface thereof, can immobilize even a larger number of the sulfur-containing molecules.

Method for Immobilization of Sulfur-Containing Molecules

The present invention can also provide a method for the immobilization (method for the immobilization of sulfur-containing molecules) of a large number of sulfur-containing molecules (preferably, a large number of sulfur-containing molecules having S—H groups or S—S groups) on the surface of a gold-plated body obtained by the above-described manufacturing method. With such an immobilization method, the sulfur-containing molecules can be immobilized on a gold-plated body in an amount unattainable by the conventional methods.

EXAMPLES

The present invention will be described below in greater detail based on examples thereof and a comparative example. The present invention is not, however, limited to the aforesaid examples.

Example 1

Preparation of Gold-Plated Body

A gold-plated body having a gold surface layer with a thickness of 2.0–3.0 $\mu$n was obtained by using a plurality of electrically conductive substrates (pins for a gene detection tip) having a Ni layer that were obtained by priming a plurality of electrically conductive materials composed of a Co—Ni—Fe alloy on the periphery thereof with Ni, immersing the substrates into a cyanide-based gold plating solution, and passing an electric current with a plating current density of 0.25 A/dm$^2$ through the substrate and the gold plating solution.

Annealing

The surface of the gold-plated body obtained was subjected to annealing at a temperature of 450° C. under a reducing gas ($H_2$+$N_2$=15:85) atmosphere. More specifically, the annealing was conducted by raising the temperature from the initial temperature (room temperature, 25° C.) at a rate of 19° C./min, terminating temperature increase when a peak temperature of 450° C. was reached, and then holding at a constant temperature. In this case, the treatment at a temperature of no less than 400° C. was conducted for about 20 min.

Content Ratio of (1, 1, 1) Planes

The content ratio (%) of (1, 1, 1) planes among the orientation planes in the gold crystal structure on the surface of the gold-plated body was calculated in the following manner by X ray diffraction measurements. The results are presented in the Table below.

The X ray diffraction measurements were conducted under usual conditions (2θ=10~100°, CuKα) with an X ray diffraction analyzer RINT1400V manufactured by Rigaku Co. The orientation of gold crystal structure can be qualitatively confirmed by the peak intensity ratio in the X ray diffraction pattern of gold. The peak intensity ratio of gold plated layer is compared with the peak intensity ratio of a reference gold powder (no orientation) and if a certain peak intensity ratio becomes large, then the orientation along this plane can be assumed. Typically the peaks of planes such as (1, 1, 1), (2, 2, 2), (1, 0, 0), and (2, 0, 0) tend to demonstrate easier orientation than other planes. For this reason, in the present example, the peak intensity of the (3, 1, 1) peak which is apparently hardly affected by orientation was selected as a reference peak and the peak intensity ratio with other peaks was calculated. The content ratio (%) of each orientation plane was calculated from the respective peak intensity ratio. Only the content ratio (%) of the (1, 1, 1) planes is presented below.

Immobilization Method

Immobilization was conducted after a pretreatment [the gold-plated body subjected to annealing was boiled for 1 h in 2M NaOH, then stirred for 30 min in 1.42 concentrated nitric acid, and thoroughly washed with ultrapure water (mill-Q water)].

An aqueous solution, 1 μL, of HS-P72 [p53 gene codon 72 SNPS (P), sequence structure: HS-(5') AGG CTG CTC CCC CCG TGG CC] as a probe containing S—H groups at 2 pmol/μL was dipped onto a plurality of pins serving as a gold-plated bodies subjected to surface treatment and a large number of molecules were immobilized on the surface of respective gold-plated bodies (overnight, room temperature). In order to prevent drying during immobilization of the probe on the pins, each of the pins was enclosed in a wet pat and the entire assembly of the plurality of pins was enclosed in a wet pat.

Immobilized Amount

Prior to calculating the immobilized amount, the HS-P72 non-specific adsorption species remaining outside the molecules immobilized by Au-S bonds were removed from the surface-treated gold-plated bodies (pins) after preliminary immobilization. The immobilized surface-treated gold-plated bodies (pins) were then immersed for 5 min into an electrolytic solution of the following composition. Composition of electrolytic solution: 50 μM FND Ferrocenylnaphthalene Diimide 0.1M acetic acid buffer (pH 5.6)

0.1M KCl

At this time, FND is concentrated in the immobilized probe by electrostatic interaction (cationic FND is electrostatically concentrated in polyphosphoric acid portion of anionic immobilized probe) or hydrophobic interaction (hydrophobic interaction between the naphthalene diimide portion of FND and a base of the immobilized probe). The amount of concentrated FND was quantitatively determined by the oxidation current value by DPV (differential pulse voltammetry) of electrochemically active ferrocene connected to bond ends of FND and the result was calculated as the amount of immobilized probe. Thus, the amount of molecules immobilized (per one pin) on the surface of pins serving as the surface-treated gold-plated bodies was determined as an electric current value (μA) The results are presented in the Table below. The higher is the current value the greater is the immobilized amount, and the lower is the current value the smaller is the immobilized amount.

Example 2

A gold-plated body subjected to surface treatment was obtained in the same manner as in Example 1, except that the annealing was conducted at a temperature of 700° C. The annealing was conducted by raising the temperature from the initial temperature (room temperature, 25° C.) at a rate of 19° C./min, terminating temperature increase when a peak temperature of 700° C. was reached, and then holding at a constant temperature. In this case, the treatment at a temperature of no less than 400° C. was conducted for about 40 min.

The content ratio (%) of (1, 1, 1) planes and immobilized amount (μA) were calculated for the obtained gold-treated body subjected to surface treatment in the same manner as in Example 1. The results are presented in the Table below.

Example 3

A gold-plated body subjected to surface treatment was obtained in the same manner as in Example 2, except that a thallium-containing crystal growth enhancer (thallium sulfate $Tl_2SO_4$) was added at a ratio of 0.002 g/L (2 ppm) to the gold plating solution.

The content ratio (%) of (1, 1, 1) planes and immobilized amount (μA) were calculated for the obtained gold-treated body subjected to surface treatment in the same manner as in Example 1. The results are presented in the Table below.

Example 4

A gold-plated body was obtained in the same manner as in Example 1, except that a thallium-containing crystal growth enhancer (thallium sulfate $Tl_2SO_4$) was added at a ratio of 0.002 g/L (2 ppm) to the gold plating solution at the stage of fabricating the gold-plated body in Example 1.

The content ratio (%) of (1, 1, 1) planes and immobilized amount (μA) were calculated for the obtained gold-plated body (no annealing) in the same manner as for the surface-treated product in Example 1. The results are presented in the Table below.

Comparative Example 1

A gold-plated body obtained in the same manner as in Example 1 was used as is, without annealing. The content ratio (%) of (1, 1, 1) planes and the immobilized amount (μA) were measured for the body in the same manner as in Example 1. The results are presented in the Table below.

Results

| | Content ratio of (1, 1, 1) planes | Immobilized amount (μA) |
|---|---|---|
| Example 1 (annealing at 450° C.) | 68.0 | 1.433 |
| Example 2 (annealing at 700° C.) | 78.7 | 1.465 |
| Example 3 (plating additive + annealing at 700° C.) | 82.5 | 2.059 |
| Example 4 (plating additive) | 36.9 | 1.648 |
| Comparative Example 1 (no plating additive and no annealing) | 13.3 | 0.798 |

The results presented above demonstrate that with the surface treatment method in accordance with the present invention, by which the surface of a gold-plated body is annealed at a temperature within the specific range (Examples 1 to 3) and with the method for the manufacture of a gold-plated body in accordance with the present invention which uses a specific plating additive (crystal growth enhancer) (Examples 3, 4), the ratio of (1, 1, 1) planes in the surface gold crystal structure of the obtained gold plated body or the surface-treated product of the gold-plated body is higher and the amount of sulfur-containing molecules immobilized on the gold surface is greater than those in Comparative Example 1 in which no annealing was conducted and no plating additive (crystal growth enhancer) was used.

The present invention provides a method for surface treatment of a gold-plated body, a surface-treated product, a method for the manufacture of a gold-plated body, a gold-plated body, and an immobilization method which make it possible to immobilize a large amount of sulfur-containing molecules.

What is claimed is:

1. A method for surface treatment of a gold-plated body, wherein a surface of the gold-plated body obtained by using electrically conductive substrates having a Ni layer on the periphery of electrically conductive materials composed of Co—Ni—Fe alloy, is subjected to an annealing treatment at a temperature of 350 to 790° C. so that a large number of sulfur-containing molecules can be immobilized thereon.

2. The method for surface treatment of a gold-plated body, according to claim 1, wherein the treatment is conducted so as to obtain a structure in which the surface gold crystals have no less than 30% planes with (1, 1, 1) orientation.

3. The method for surface treatment of a gold-plated body, according to claim 1 or claim 2, wherein said gold-plated body is an electroplated body obtained by immersing an electrically conductive substrate in a gold plating solution and passing an electric current through said electrically conductive substrate and said gold plating solution.

4. The method for surface treatment of a gold-plated body, according to claim 3, wherein a crystal growth enhancer is added to said gold plating solution.

5. The method for surface treatment of a gold-plated body, according to either claim 1 or claim 2, wherein said sulfur-containing molecule comprises a nucleic acid residue, a protein residue, or a protein-bondable group.

6. The method for surface treatment of a gold-plated body, according to claim 1 or claim 2, wherein said sulfur-containing molecule is a probe for detecting a gene with an unconfirmed base sequence.

7. A method for the immobilization of sulfur-containing molecules, wherein a large number of sulfur-containing molecules are immobilized on a surface-treated product of a gold-plated body, wherein the surface-treated product is obtained by conducting a surface treatment comprising subjecting a surface of the gold-plated body to an annealing treatment at a temperature of 350 to 790° C.

8. The method of claim 7, wherein the surface treatment is conducted so as to obtain a structure in which the surface gold crystals have no less than 30% planes with (1, 1, 1) orientation.

9. A method for the manufacture of a gold-plated body, obtained by using electrically conductive substrates having a Ni layer on the periphery of electrically conductive materials composed of Co—Ni—Fe alloy, that allows a large number of sulfur-containing molecules to be immobilized on the surface thereof, wherein surface gold crystals are formed from a starting material comprising a crystal growth enhancer.

10. The method for the manufacture of a gold-plated body, according to claim 9, wherein the gold-plated body is obtained by adding a crystal growth enhancer to a gold plating solution, immersing an electrically conductive substrate therein, and passing an electric current through said electrically conductive substrate and said gold plating solution having the crystal growth enhancer added thereto.

11. The method for the manufacture of a gold-plated body, according to claim 9 or claim 10, wherein the formation of the surface gold crystals is conducted so as to obtain a structure in which the surface gold crystals have no less than 30% planes with (1, 1, 1) orientation.

12. The method for the manufacture of a gold-plated body, according to claim 9 or claim 10, wherein said sulfur-containing molecule comprises a nucleic acid residue, a protein residue, or a protein-bondable group.

13. The method for the manufacture of a gold-plated body, according to claim 9 or claim 10, wherein said sulfur-containing molecule is a probe for detecting a gene with an unconfirmed base sequence.

14. A method for the immobilization of sulfur-containing molecules, wherein a large number of sulfur-containing molecules are immobilized on a gold-plated body, wherein the gold-plated body is obtained by a manufacturing method comprising forming surface gold crystals from a starting material comprising a crystal growth enhancer.

15. The method of claims 14, wherein the gold-plated body is obtained by adding a crystal growth enhancer to a gold plating solution, immersing an electrically conductive substrate therein, and passing an electric current through said electrically conductive substrate and said gold plating solution having the crystal growth enhancer added thereto.

* * * * *